United States Patent [19]

Klaucic

[11] Patent Number: 4,715,426

[45] Date of Patent: Dec. 29, 1987

[54] MACHINE FOR THE CURVED CONTINUOUS CASTING WITH RIGID STARTING BAR

[75] Inventor: Luciano Klaucic, Gorizia, Italy

[73] Assignee: Continua International Continuous Casting S.p.A., Italy

[21] Appl. No.: 928,808

[22] Filed: Nov. 7, 1986

[30] Foreign Application Priority Data

Nov. 27, 1985 [IT] Italy ..... 12611 A/85

[51] Int. Cl.[4] ..... B22D 11/08

[52] U.S. Cl. ..... 164/426; 164/446

[58] Field of Search ..... 164/425, 426, 445, 446, 164/483

[56] References Cited

U.S. PATENT DOCUMENTS

| | | | |
|---|---|---|---|
| 3,344,844 | 10/1967 | Reinfeld et al. | 164/426 |
| 3,426,835 | 2/1969 | Michelson | 164/426 |
| 4,043,383 | 8/1977 | Isenberg et al. | 164/426 |
| 4,457,353 | 7/1984 | Meurer | 164/426 |
| 4,632,175 | 12/1986 | McVay et al. | 164/446 |

FOREIGN PATENT DOCUMENTS

| | | | |
|---|---|---|---|
| 66550 | 12/1982 | European Pat. Off. | 164/426 |

*Primary Examiner*—Nicholas P. Godici
*Assistant Examiner*—Richard K. Seidel
*Attorney, Agent, or Firm*—King & Schickli

[57] ABSTRACT

This invention relates to a machine for the curved continuous casting of metals, particularly steel, with a semi-rigid starting bar (20) comprised of two successive segments (120, 220) pivoted to each other (21). In the stowed position of the starting bar (20), the leading segment (120) of the starting bar (20) is folded upwards, together with a swingable arm (122) of the supporting structure (22) for the starting bar (20), to a position wherein the inspection and maintenance of the connecting or coupling head may be effected more easily. Preferably, the trailing segment (220) of the starting bar (20) has the same cross section as the strand of the smallest section to be cast in the machine, whereas the leading segment (120) has a cross section corresponding to that of the strand which is cast at each time, so that it can be removed and replaced.

9 Claims, 3 Drawing Figures

220
22
24
29
25
23
20
21
24
120
8
28
27
25
30
24
17
15
31
10
9
11
14
3
19
4
5
7
1
2
6

220
22
20
24
24
28
29
30
222
27
25
25
26
26
24
31
122
120
24
21+23
11
13
15
16
10
8
7
14
17
9

MACHINE FOR THE CURVED CONTINUOUS CASTING WITH RIGID STARTING BAR

SUMMARY OF THE INVENTION

This invention relates to the machines for the curved continuous casting of metals, particularly steel, wherein a strand which is cast in a substantially vertical direction, particularly by means of a curved, open or bottomless ingot mold, follows first a curved path wherefrom it emerges into a substantially horizontal direction by passing through a reversible extractor-straightener device. This casting machine has associated therewith a semi-rigid, curved starting bar having substantially the same curvature as the curved path of the cast strand, and alternately positionable in a starting position wherein its connection head closes the bottom outflow opening of said ingot mold, and its trailing end is engaged in the pair of powered reversible pinch rollers of the extractor-straightener device, and a stowed position wherein it is disengaged from said extractor-straightener device and is engaged in supporting means and in guide and transfer means provided in a stowage area above the horizontal stretch of the cast strand.

In the heretofore known casting machines of this type, when the starting bar is in its stowed position, the head of the bar is located in a lower position, just after the extractor-straightener device and just above the horizontal path of travel of the cast strand, whereby it is difficult, or at least uncomfortable to carry out the maintenance and/or replacement of the head of said starting bar.

The invention aims primarily to eliminate said disadvantage, and is substantially characterized in that the starting bar is comprised of two successive rigid segments, namely a leading segment and a trailing segment, which are articulated to each other by a transverse horizontal pivot that, in the stowage position of the starting bar, may be in register with a corresponding pivot whereabout the starting bar supporting means is articulated, whereby the articulated lower portion of said supporting means may be folded upwards together with the leading segment of the starting bar, so as to transfer the connecting head of said bar to a readily accessible position, for example, in front of a working gangway or platform, arranged at a certain level above the horizontal path of travel of the cast strand. When the lower section of the starting bar supporting means in the stowage area is folded upwards together with the articulated leading segment of said bar, any maintenance and/or replacement operation on the head of said starting bar may be carried out easily even during a casting operation.

The mutually articulated leading and trailing segments of the starting bar of a casting machine according to the invention may have substantially the same cross section all over their length. In this instance, for each cast strand of different cross section a corresponding starting bar having all over its length the same cross section as the strand to be cast must be provided. As a result, each time the cross section of the cast strand is changed, the entire starting bar must be changed, thus imposing to store and to handle bulky and heavy entire starting bars.

The solution according to the invention overcomes also this drawback. For this purpose, in a particularly advantageous embodiment of the invention, the trailing segment of the starting bar has a cross section corresponding to the smallest cross section of the strand to be cast by the machine, while the leading segment has a cross section corresponding to the cross section of the strand to be cast at each time and is pivoted to the trailing segment so as to be easily removed and replaced.

By virtue of the possibility, according to the invention, to fold upwards the lower portion of the supporting means for the starting bar in the stowage area, together with the pivotable leading segment of said starting bar, the replacement of the starting bar leading segment may be effected easily even during a casting operation, for example, from said gangway or platform arranged at a certain level above the horizontal path of travel of the cast strand. When changing the cross section of the cast strand, only the leading segment of the starting bar according to the invention needs to be changed, thus reducing considerably the weight and dimensions of the members to be stored and to be handled.

The supporting, guiding and transferring means for the starting bar in its stowage area, the pivotal connection in said supporting means and the pivotal connection between the leading and trailing segments of the starting bar, as well as the means for folding upwards the lower portion of said supporting means and leading segment of the starting bar and, therefore, for lowering them back in line with the upper portion of said supporting means and trailing segment of the starting bar, may be constructed in any suitable manner. Thus, for example, the transfer means for the starting bar in the supporting and guiding means in the stowage area may be comprised of at least one pair of powered pinch or drawing rollers which co-operate with the trailing segment of the starting bar and which, preferably, are of the reversible type.

The angular lifting and lowering movements of the lower portion of the supporting means in the stowage area, together with the leading segment of said bar, may be carried out, for example, by a powered winch or the like.

BRIEF DESCRIPTION OF THE DRAWINGS

These and other characteristics of the invention and the advantages resulting therefrom will be apparent in more detail from the following description of an exemplary embodiment thereof, shown in the accompanying drawings, wherein.

DESCRIPTION OF THE PREFERRED EMBODIMENT

Figure 1:
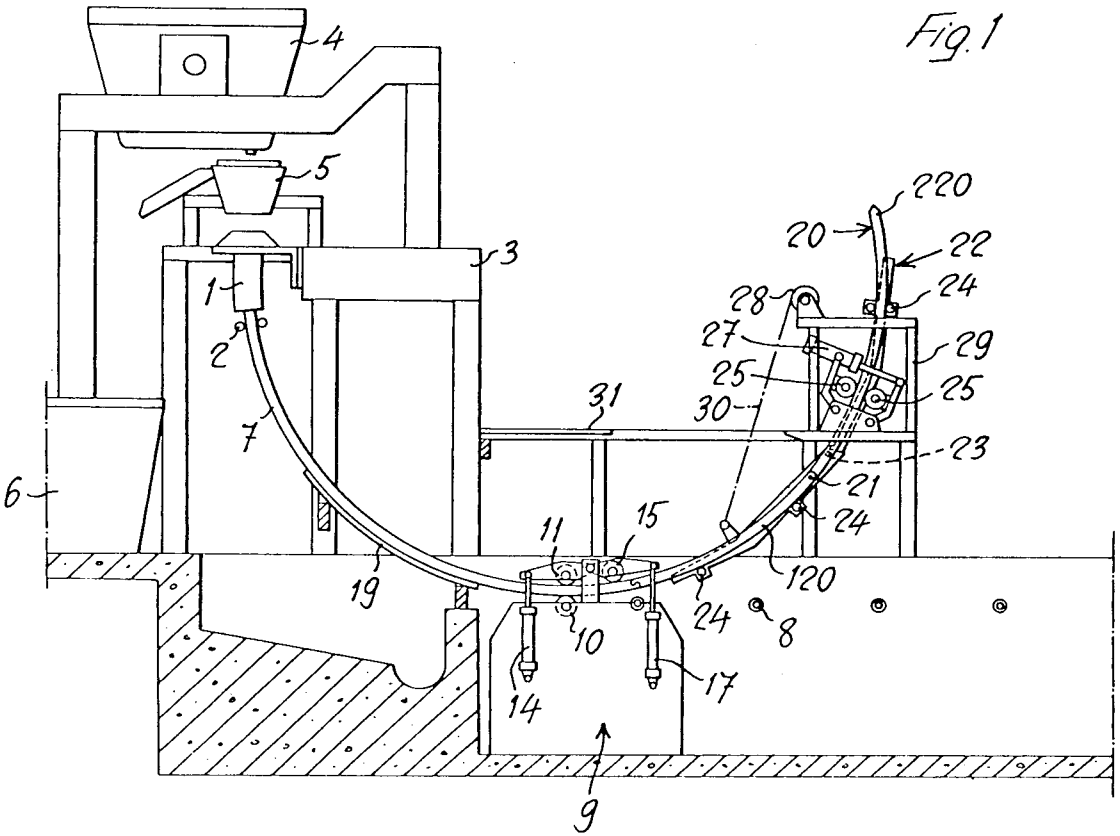
FIG. 1 is a diagrammatic side elevational view of a continuous casting machine according to the invention.

With reference to the figures, the numeral 1 indicates the open or bottomless ingot mold of a machine for the continuous casting of metals, including steel, particularly in the form of square section strands up to 150 mm square. The ingot mold 1 is of arcuate shape and is solidary with rollers 2 located at its bottom outlet, and is followed, if desired, by a short arcuate cage of guide rolls (not shown), either solidary with or separate and independent form said mold. The mold 1 is of the swingable type and is controlled by an oscillator unit 3. The ladle 4 pours the molten metal into the tundish 5 therebelow, and the latter, generally, dispenses the molten metal to two or more underlying ingot molds 1, each associated with a casting line.

The numeral 6 indicates a pail whereinto the molten metal from the intermediate tundish 5 may be poured in an emergency case.

The cast strand 7 outflowing in a substantially vertical or nearly vertical direction from the bottom opening of the ingot mold follows a curved path of travel along an arc of a circle wherefrom it emerges into a substantially horizontal direction, for example, on a roller runway 8. At the end of said curved path of travel, between the latter and the adjacent horizontal rectilinear path of travel of the cast strand 7, there is arranged a reversible extractor-straightener device 9 comprising a pair of powered pinch rollers 10, 11. The upper pinch roller 11 is carried by a lever 12 pivotable about its fulcrum 13 and may be moved toward and away from the lower roller 10 by means of a hydraulic or pneumatic actuating cylinder 14. Downstream of the pair of pinch rollers 10, 11 there is provided an upper straightener roller 15 which is arranged on a lever 16 pivoted about the fulcrum 13 and may be raised and lowered by means of a hydraulic or pneumatic actuating cylinder 17.

The initial portion of the arcuate path of travel of the cast strand 7 is, preferably, devoid of guide means for the strand. In the remaining portion of said arcuate path, below the spray cooling chamber (not shown) and as far as to the extractor-straightener device 9, there is provided, preferably, a strand guide means which may be of any construction and may comprise, for example, idle rollers arranged at least on the extrados side, or a strand guide chute 19 made of plate and arranged on the extrados side. Preferably, said strand guide means are sufficiently offset forwards of the vertical axis at the mold 1, so as to avoid being hit by metal drippings if the solidified skin of the cast strand should break in the spray cooling chamber or thereabove.

The continuous casting machine has associated therewith a curved starting bar 20, comprised of two successive rigid segments, namely a leading segment 120 and a trailing segment 220, having the same curvature and being pivoted to each other at 21. As a whole, the curvature of the starting bar 20 conforms to the arcuate path of travel of the cast bar 7 between the mold 1 and the extractor-straightener device, and the total length of said starting bar 20 is at least slightly larger than the length of said path of travel between the mold 1 and the pair of pinch rollers 10, 11 of the extractor-straightener device 9.

The trailing segment 220 of the starting bar 20, preferably, has a cross section corresponding to that of the strand 7 having the smallest section that may be cast with the continuous casting machine, whereas the leading segment 120 of the starting bar 20 has a cross section corresponding to that of the strand 7 to be cast each time. Therefore, when the cross section of the cast strand 7 is changed, only the leading segment 120 of the starting bar 20 needs to be changed. For this purpose, the leading segment 120 of the starting bar 20 is pivoted to the trailing segment 220 in an easily disconnectible and re-connectible manner, by means readily conceivable by those skilled in the art.

The starting bar 20 has a stowed position downstream of the extractor-straightener device 9 above the roller runway 8 for the cast strand 7. For this purpose, in the stowage area downstream of the extractor-straightener device 9, there is provided a folding starting bar support-guide means for the starting bar along a curved path in the form of an arc of a circle, constituting the extension of the arcuate path of travel of the cast strand 7 between the mold 1 and the extractor-straightener device 9 and having the same curvature thereof. In the illustrated embodiment, the supporting means for the starting bar 20 in the stowage area comprises a structure 22 conforming, with a curved or broken line configuration, to the curved path of travel of the starting bar in the stowage area and comprising a stationary upper portion 222 and a displaceable portion or swingable lower arm 122 pivotable about a fulcrum 23 with respect to the stationary upper portion 222. The means for guiding the starting bar 20 on its arcuate path of travel in the stowage area comprises guide rollers 24 carried by the swingable lower arm 122 and by the stationary upper portion 222 of the starting bar supporting structure 22. Preferably, at the swingable lower arm 122 of the starting bar supporting structure 22, said guide rollers 24 are arranged only on the extrados side of the starting bar 20. At the stationary upper portion 222 of the starting bar supporting structure 22 there is provided a pair of powered rollers 25 for displacing the starting bar 20 in the stowage area. Said powered rollers 25 may be of the reversible type and are mounted on swingable levers 26 which may be actuated by a hydraulic or pneumatic cylinder 27 so as to move said rollers 25 toward and away from said starting bar 20. At the swingable lower arm 122 and/or the stationary upper portion 222 of the starting bar supporting structure 22 there may be provided any suitable locking mechanism (not shown) for holding the starting bar 20 in the stowed position thereof, thus preventing it from sliding down.

The length of the swingable lower arm 122 of the starting bar supporting structure 22 is substantially the same as the length of the leading segment 120 of said starting bar 20. Said swingable lower arm 122 of the supporting structure 22 may be moved angularly about its fulcrum 23 by means of a winch 28 which is mounted on the frame 29 of the continuous casting machine and is connected through the rope 30 to said swingable lower arm 122. At the beginning of the casting step, the starting bar 20 is on the arcuate path of travel of the cast strand between the ingot mold 1 and the extractor-straightener device 9 and is engaged with its connecting head (free end portion of the leading segment 120) in the bottom opening of the mold 1, whereas its trailing end (free end portion of the trailing segment 220) is engaged between said powered rollers 10, 11 of said extractor-straightener device 9. The starting bar 20 is then pulled out of the mold 1 and is moved past the extractor-straightener device 9 toward its stowed position by the pair of powered rollers 10, 11 of said extractor-straightener device 9, while the straightener roller 15 is in a raised position. The starting bar 20 is thus introduced into the supporting structure 22 in the stowage area, and its trailing segment 220 is engaged between the powered rollers 25 before its leading segment 120 is disengaged from the powered pinch rollers 10, 11 of the extractor-straightener device 9. As a result, when the leading segment 120 of the starting bar 20 disengages from the pair of powered pinch rollers 10, 11 of the extractor-straightener device 9, the lifting movement of the starting bar 20 in the supporting structure 22 is continued by the action of the pair of powered rollers 25.

Figure 2:
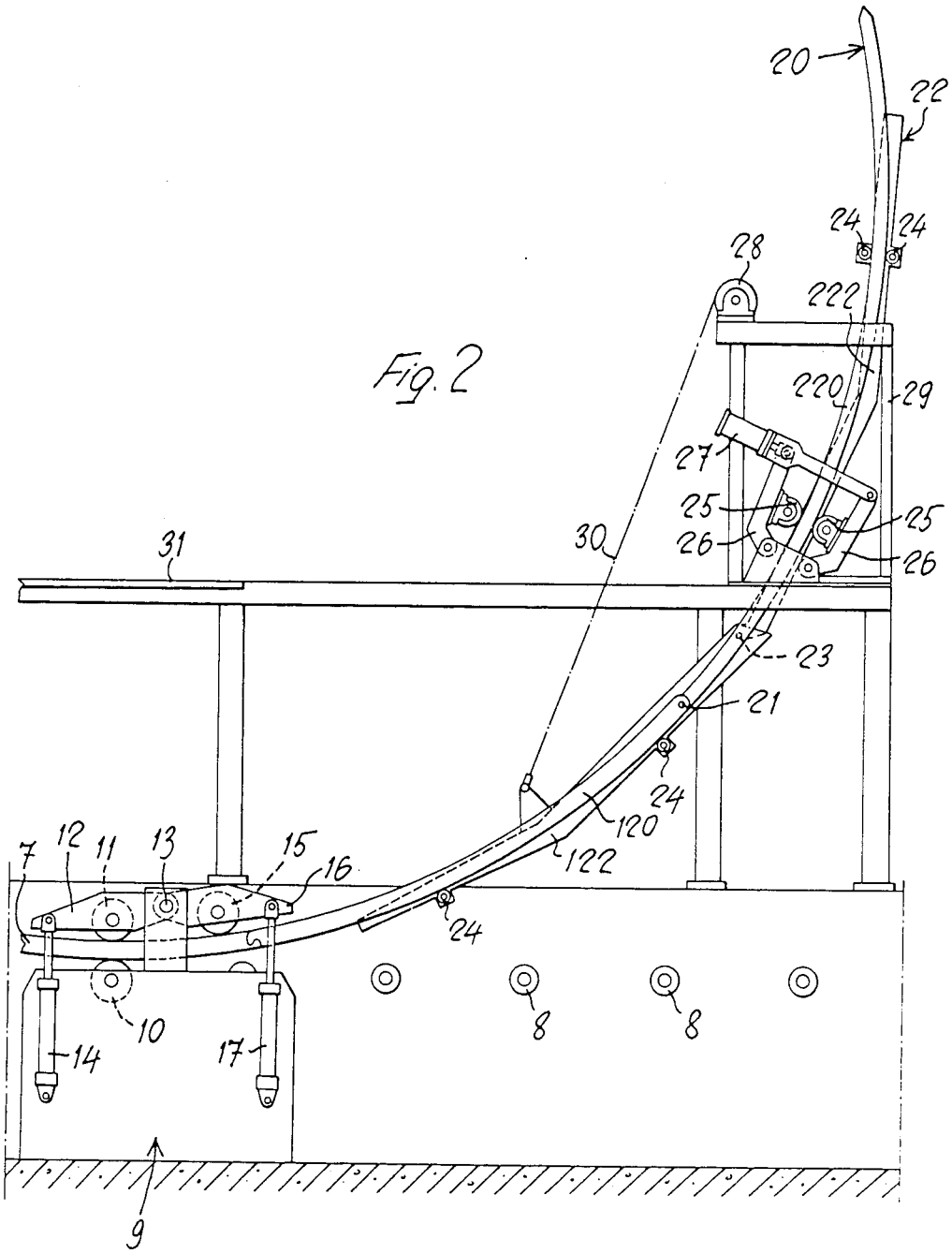
FIG. 2 is an enlarged view of the stowage area for the starting bar of the continuous casting machine of figure 1, the starting bar being shown in the final introduction movement into said area.

When the connection between the leading segment 120 of the starting bar 20 and the cast strand 7 has passed beyond the raised straightener roller 15, as shown in the FIGS. 1 and 2, said roller 15 is lowered, thus causing the disconnection of the starting bar 20 from the cast strand 7 and the straightening of the latter, whereby said strand goes on along its horizontal path of travel on the roller runway 8. The starting bar is lifted further by the powered rollers 25 in the supporting structure 22, until it reaches a stowed position wherein the pivot 21 between its leading and trailing segments 120, 220 registers with the pivot 23 of the swingable lower arm 120 of said supporting structure 20.

Figure 3:
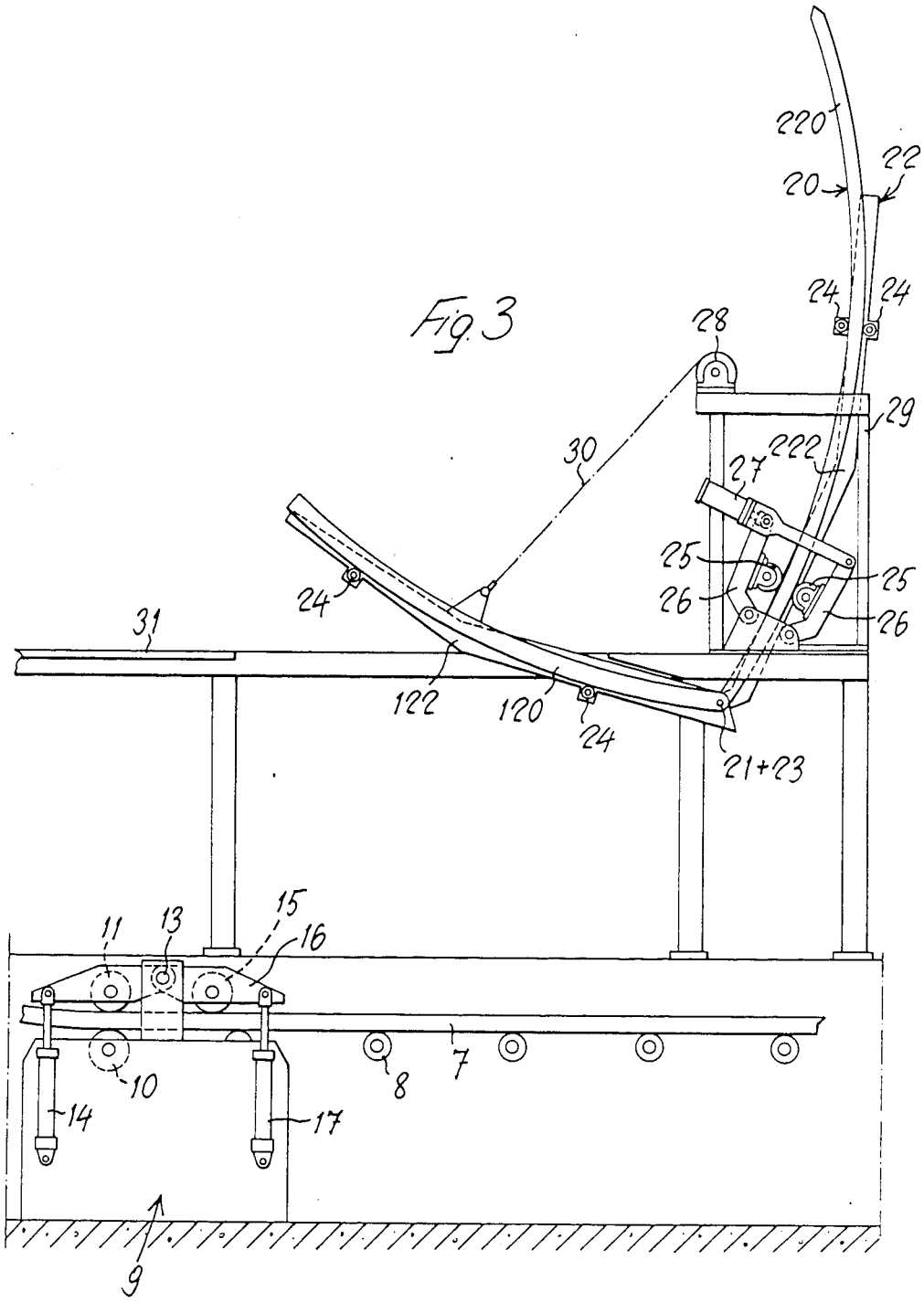
FIG. 3 is a side elevational view similar to FIG. 2, with the starting bar in the completely stowed position and with the leading segment thereof folded upwards.

In this position, the starting bar 20 is locked against any sliding displacement in the supporting structure 22, for example, only in the stationary upper portion 222 thereof, and the swingable lower arm 122 of the supporting structure 22 is lifted angularly about its pivot 23 by means of the winch 28 and together with the leading segment 120 of the starting bar 20, as shown in FIG. 3. In this lifted position of the swingable arm 122, any inspection and maintenance of the connecting head of the starting bar leading segment 120 in view of the next casting step may be effected easily and readily, even during a casting operation, from a working platform or gangway 31. Moreover, when the machine must be set up for casting a strand of different cross section, an operator on the same working platform can effect the replacement of the leading segment 120 of the starting bar 20 with another leading segment 120 corresponding to the cross section to be cast.

For this purpose, the working platform or gangway 31 is arranged at such a level to permit to reach easily the pivot 23 of the swingable arm 122 and then the pivot 21 between the two segments 120 and 220 of the starting bar 20.

In order to re-engage the connecting head of the starting bar 20 into the bottom opening of the ingot mold 1 in view of a new casting step, the swingable lower arm 122 of the starting bar supporting structure 22 in the stowed position is angularly lowered down about its pivot 23 together with the leading segment 120 of said starting bar 20 into a position in line with the stationary upper portion 222 of said supporting structure 22, thus aligning the leading segment 120 with the trailing segment 220 of the starting bar. The starting bar 20 is then unlocked and lowered onto the guides 24 of the supporting structure 22, until the free end of its leading segment 120 is re-engaged between the powered pinch rolls 10, 11 of the extractor-straightener device 9. Such a lowering movement of the starting bar 20 may be effected by gravity and may be controlled by a suitable braking action by the rollers 25 and/or may be caused by said powered rollers 25. The starting bar 20 is then moved toward the mold 1 along the curved path of travel of the cast strand 7 upstream of the extractor-straightener device 9 by the action of the powered rollers 10, 11 of said machine, which are rotated reversely from the rotation occurred during the casting step.

I claim:

1. A machine for the curved continuous casting of metals, particularly steel, including a mold for producing a cast strand, a curved casting path leading from said mold to a substantially horizontal cast strand path, a reversible extractor-straightener means for straightening and advancing said cast strand and a starting bar having a head and a tail end, said starting bar having substantially the same curvature as the curved casting path and being positionable between a starting position wherein the head end closes the mold and the tail end is engaged by said extractor-straightener means and a stowed position disengaged from said mold and said extractor-straightener means above said substantially horizontal cast strand path, the improvement comprising:

a starting bar having a leading rigid segment, a trailing rigid segment, and means for pivotally connecting said segments together in succession; and a folding starting bar support-guide means including a displaceable portion and means for pivotally connecting said displaceable portion to said support-guide means; said folding starting bar support-guide means being specially adapted so that the pivotal connecting means of said starting bar and said support-guide means may be brought into register when said starting bar is in the stowed position and the displaceable portion folded with the leading segment of said starting bar so as to move the head end of the starting bar away from the cast strand path to a readily accessible position.

2. A machine according to claim 1, characterized in that said trailing segment of the starting bar has a cross section corresponding to that of the cast strand of smallest or largest cross section that may be cast by the machine, while the leading segment has a cross section corresponding to that of the cast strand that is to be cast each time, said leading segment being pivotally connected to the trailing segment so as to be disconnectable and replaceable.

3. A machine according to claim 1, characterized in that said machine includes a working platform or gangway, the pivotal connecting means between the displaceable portion and said folding support-guide means and the pivotal connecting means between the leading segment and the trailing segment of the starting bar being easily accessible in the stowed position for inspection and maintenance from said working platform or gangway.

4. A machine according to claim 1, characterized in that the folding support-guide means for the starting bar includes a stationary upper portion and said displaceable portion is in the form of a swingable lower arm which is pivoted to the stationary upper portion in registry with the path of travel of the starting bar.

5. A machine according to claim 4, characterized by powered means for displacing angularly the swingable lower arm of the folding starting bar support-guide means.

6. A machine according to claim 5, characterized in that means for displacing the starting bar in the stowed position comprises at least a pair of reversible powered pinch or drawing rollers.

7. A machine according to claim 4, characterized in that guide means are provided on said lower arm only on the extrados side thereof.

8. A machine according to claim 1, characterized in that the folding starting bar support-guide means includes guide rollers for receiving said starting bar.

9. A machine according to claim 1, characterized in that the folding starting bar support-guide means includes a chute for receiving said starting bar.

* * * * *